US011686058B2

(12) United States Patent
Schwingler et al.

(10) Patent No.: US 11,686,058 B2
(45) Date of Patent: Jun. 27, 2023

(54) SNOW BLOWER IMPLEMENT

(71) Applicant: Clark Equipment Company, West Fargo, ND (US)

(72) Inventors: Eric Schwingler, Bismarck, ND (US); Jason Legatt, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 229 days.

(21) Appl. No.: 16/820,067

(22) Filed: Mar. 16, 2020

(65) Prior Publication Data

US 2020/0291591 A1 Sep. 17, 2020

Related U.S. Application Data

(60) Provisional application No. 62/818,467, filed on Mar. 14, 2019.

(51) Int. Cl.
*E01H 5/09* (2006.01)
*E01H 5/04* (2006.01)

(52) U.S. Cl.
CPC ..... *E01H 5/098* (2013.01); *E01H 5/045* (2013.01)

(58) Field of Classification Search
CPC ..... E01H 5/098; E01H 5/045
See application file for complete search history.

(56) References Cited

U.S. PATENT DOCUMENTS 3,431,662 A * 3/1969 Bles ..... E01H 5/065 414/722
5,163,239 A * 11/1992 Lampe ..... E01H 5/045 37/260
7,712,232 B2 * 5/2010 Majkrzak ..... E01H 5/098 37/249
9,598,829 B2 * 3/2017 Betts ..... E01H 5/098
9,629,299 B2 * 4/2017 Swanson ..... E02F 3/7631
9,723,771 B2 * 8/2017 Bessette ..... A01B 1/02
9,885,167 B2 * 2/2018 Behr ..... E02F 9/2275
10,356,971 B2 * 7/2019 DeVries ..... A01B 59/064
(Continued)

FOREIGN PATENT DOCUMENTS

GB 2 048 654 A 12/1980
KR 10-2010-0074515 A 7/2010
SU 1740695 A1 * 6/1992

OTHER PUBLICATIONS

Notification of Transmittal of the International Search Report and the Written Opinion of the International Searching Authority, or the Declaration (including the International Search Report and Written Opinion) for International Application No. PCT/US2020/022967, dated Jun. 24, 2020, 13 pages.

*Primary Examiner* — Jessica H Lutz
(74) *Attorney, Agent, or Firm* — John Veldhuis-Kroeze; Westman, Champlin & Koehler, P.A.

(57) ABSTRACT

A snow blower implement for a power machine includes a power machine interface having a machine mount configured to engage the implement interface of the power machine. A tool of the implement is coupled to the power machine interface. The tool includes a frame forming an auger housing, and the auger housing includes apertures formed in the housing and arranged to proved an operator of the power machine with visibility, through the apertures, of an implement workspace within or in front of the auger housing while operating the power machine.

19 Claims, 7 Drawing Sheets

(56) References Cited

U.S. PATENT DOCUMENTS

| | | | | |
|---|---|---|---|---|
| 10,767,327 | B2 * | 9/2020 | Champagne | F16H 7/1209 |
| 11,111,643 | B2 * | 9/2021 | Bergman | E01H 5/098 |
| 2002/0178622 | A1 | 12/2002 | Loegering et al. | |
| 2007/0020079 | A1 * | 1/2007 | Boyapally | E02F 3/3604 414/723 |
| 2018/0309962 | A1 | 10/2018 | Shimizu | |
| 2019/0264405 | A1 * | 8/2019 | Duchscherer | E01H 5/098 |
| 2021/0332542 | A1 * | 10/2021 | Kueper | E01H 5/061 |

* cited by examiner

SNOW BLOWER IMPLEMENT

CROSS-REFERENCE TO RELATED APPLICATION

This application claims the benefit of U.S. Provisional Application No. 62/818,467, which was filed on Mar. 14, 2019.

BACKGROUND

The present disclosure is related to implements and accessories for implements that are attachable to power machines. More particularly, the present disclosure is related to implements or implement accessories that include a snow blower with an auger housing.

Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Some examples of work vehicle power machines include loaders, excavators, utility vehicles, tractors, and trenchers, to name a few.

One type of implement is a snow blower having an auger housing with an auger that rotates to urge snow or other material to an impeller. The impeller can then drive the snow or material upwardly through a discharge chute. Such a snow blower with an auger and an impeller is commonly as a two-stage snow blower. Typically, it is difficult for an operator of the power machine on which the snow blower implement is mounted to have a clear view of the area directly in front of the auger housing of the implement. The housing itself blocks the operator's view, potentially allowing the implement to come into contact with objects or materials which were not intended. This can result in damage to the snow blower or to the objects or materials.

The discussion in this Background is merely provided for general background information and is not intended to be used as an aid in determining the scope of the claimed subject matter.

SUMMARY

This Summary and the Abstract are provided to introduce a selection of concepts in a simplified form that are further described below in the Detailed Description. The summary and the abstract are not intended to identify key features or essential features of the claimed subject matter.

Disclosed embodiments include snow blower implements having an auger housing with one or more groups of apertures formed in a top or back wall in a pattern or arrangement to provide visibility through the housing, while minimizing material passing through the apertures.

In accordance with disclosed embodiments, one general aspect includes an implement (100; 100'; 100"; 200; 300; 400) configured to be coupled to an implement interface (40) of a power machine (10), the implement including: a power machine interface (110; 110'; 110"; 210; 310; 410) having a machine mount (112; 112'; 112"; 212; 312; 412) configured to engage the implement interface of the power machine; and a tool (120; 120'; 120"; 220; 320; 400) coupled to the power machine interface, the tool having a frame (122; 122'; 122"; 222; 322; 422) forming a housing, where the housing includes at least one aperture (262; 264; 362; 364; 462; 464; 466; 468) formed in the housing configured and arranged to provide an operator of the power machine with visibility, through the at least one aperture, of an implement workspace while operating the power machine.

Implementations may include one or more of the following features. The implement where the housing includes first and second spaced apart side plates (240; 242; 340; 342; 440; 442) on outer sides of the implement, and at least one laterally extending section (244; 246; 248; 344; 348; 444; 446) between the first and second spaced apart side plates, where the at least one aperture is formed in the at least one laterally extending section. The implement where the at least one laterally extending section includes a curved back wall (344) and where the at least one aperture is formed in the curved back wall.

The implement where the implement is a snow blower, where the housing is an auger housing, and where the at least one laterally extending section includes a bottom plate (348) extending between the side plates and configured to function as a scraper to scoop snow into the housing.

The implement where the implement is a snow blower, where the housing is an auger housing, and where the at least one laterally extending section includes a rear wall (244), a top wall (246) extending between the side plates, and a bottom plate (248) extending between the side plates and configured to function as a scraper to scoop snow into the housing. The implement where the at least one aperture is formed in the top wall of the housing.

The implement where the at least one aperture includes at least one group of apertures formed in the housing. The implement where the at least one group of apertures formed in the housing includes at least one diagonally oriented slot formed in the housing. The implement where the at least one group of apertures includes a plurality of diagonally oriented slots arranged parallel to each other.

The implement where the implement is a bucket (400).

Another general aspect includes a snow blower implement (100; 100'; 100"; 200; 300) configured to be coupled to an implement interface (40) of a power machine (10), the snow blower implement including: a power machine interface (110; 110'; 110"; 210; 310) having a machine mount (112; 112'; 112"; 212; 312) configured to engage the implement interface of the power machine; and a rotary snow blowing tool (120; 120'; 120"; 220; 320) coupled to the power machine interface, the rotary snow blowing tool having a frame (122; 122'; 122"; 222; 322) forming an auger housing, where the auger housing includes: first and second spaced apart side plates (240; 242; 340; 342) on outer sides of the auger housing; at least one laterally extending section (244; 246; 248; 344; 348) between the first and second spaced apart side plates; and an aperture (262; 264; 362; 364) formed in the at least one laterally extending section to provide an operator of the power machine with visibility, through the aperture, of an implement workspace.

Implementations may include one or more of the following features. The snow blower implement where the at least one laterally extending section, in which the aperture is formed, is a top wall of the auger housing. The snow blower implement where the at least one laterally extending section, in which the aperture is formed, is a sloped back wall of the auger housing. The snow blower implement where the aperture includes a first group of apertures arranged in a pattern. The snow blower implement where the aperture includes a second group of apertures arranged in a pattern, each of the first and second groups of apertures formed on different sides of the at least one laterally extending section.

Another general aspect includes an implement (100; 100'; 100"; 200; 300; 400) configured to be coupled to an implement interface (40) of a power machine (10), the implement including: a power machine interface (110; 110'; 110"; 210; 310; 410) having a machine mount (112; 112'; 112"; 212; 312; 412) configured to engage the implement interface of the power machine; and a tool (120; 120'; 120"; 220; 320; 400) coupled to the power machine interface, the tool having a frame (122; 122'; 122"; 222; 322; 422) forming a housing, where the housing includes at least one group of apertures (262; 264; 362; 364; 462; 464; 466; 468) formed in the housing configured and arranged to provide an operator of the power machine with visibility, through the at least one group of apertures, of an implement workspace while operating the power machine.

Implementations may include one or more of the following features. The implement where the housing includes first and second spaced apart side plates (240; 242; 340; 342; 440; 442) on outer sides of the implement, and at least one laterally extending section (244; 246; 248; 344; 348; 444; 446) between the first and second spaced apart side plates, where the at least one group of apertures is formed in the at least one laterally extending section. The implement where the at least one laterally extending section includes a curved back wall (344) and where the at least one group of apertures is formed in the curved back wall.

Another general aspect includes an implement (100; 100'; 100"; 200; 300; 400) configured to be coupled to an implement interface (40) of a power machine (10), the implement including: a power machine interface (110; 110'; 110"; 210; 310; 410) having a machine mount (112; 112'; 112"; 212; 312; 412) configured to engage the implement interface of the power machine; a tool (120; 120'; 120"; 220; 320; 400) coupled to the power machine interface, the tool including: a frame (122; 122'; 122"; 222; 322; 422) forming a housing; an actuator (252) configured to perform a work function; and at least one aperture (262; 264; 362; 364; 462; 464; 466; 468) formed in the housing and configured and arranged to provide an operator of the power machine with visibility, through the at least one aperture, of an implement workspace while operating the power machine.

BRIEF DESCRIPTION OF THE DRAWINGS

FIGS. 7-1 through 7-3 are diagrammatic illustrations of example aperture shapes and orientations in accordance with disclosed embodiments.

DETAILED DESCRIPTION

Figure 1:
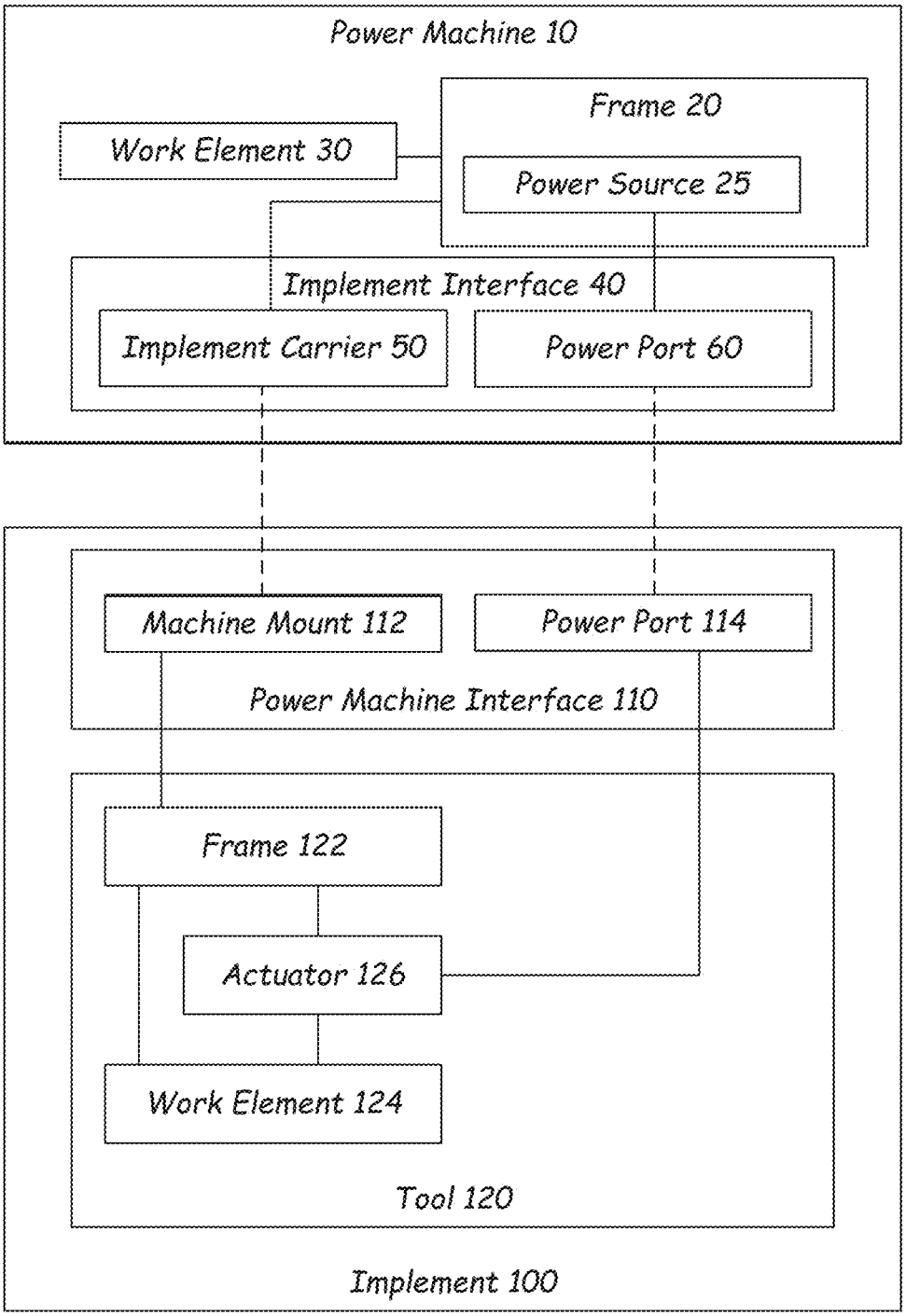
FIGS. 1-3 are each block diagrams illustrating functional systems of a representative implement on which embodiments of the present disclosure can be practiced and a power machine to which the representative implement can be coupled.

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed concepts are used to increase visibility of the area in front of the housing of an implement, such as in front of an auger housing of a snow blower implement or in front of a bucket implement, to reduce contact with obstacles, structures or other materials which could damage the snow blower and/or the contacted structures or materials. In accordance with disclosed concepts, one or more apertures are formed in a top wall of an auger housing in a pattern which enhances visibility of the area in front of the auger housing. Power machine 10 includes an operator station that includes an operating position from which an operator can control operation of the power machine. In some power machines, the operator station 150 is defined by an enclosed or partially enclosed cab, though this need not be the case in all embodiments. An implement workspace includes an area in front of, or even within, the housing or frame of the implement where the implement engages material such as snow or dirt to perform a work function such as digging, loading, or gathering snow in an auger. Disclosed embodiments include at least one aperture, and in some embodiments, groups of apertures, formed in a housing of a tool of the implement to provide an operator of the power machine positioned in the operator station with visibility, through the aperture, of the implement workspace.

Disclosed concepts can be practiced on various implements and various power machines, as will be described below. Representative implements 100, 100', 100" on which the embodiments can be practiced and representative power machines 10 and 10' to which the implement can be operably coupled are illustrated in diagram form in FIGS. 1-3 and described below before any embodiments are disclosed. For the sake of brevity, only one implement and power machine combination is discussed in detail. However, as mentioned above, the embodiments below can be practiced on any of a number of implements and these various implements can be operably coupled to a variety of different power machines. Power machines, for the purposes of this discussion, include a frame, in some instances at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Referring now to FIG. 1, a block diagram illustrates basic systems of power machine 10 as are relevant to interact with implement 100 as well as basic features of implement 100, which represents an implement upon which the embodiments discussed below can be advantageously incorporated. At their most basic level, power machines for the purposes of this discussion include a frame 20, a power source 25, a work element 30, and, as shown in FIG. 1, an implement interface 40. On power machines such as loaders and excavators and other similar work vehicles, implement interface 40 includes an implement carrier 50 and a power port 60. The implement carrier 50 is typically rotatably attached to a lift arm or another work element and is capable of being secured to the implement. The power port 60 provides a connection for the implement 100 to provide power from the power source to the implement. Power source 25 represents one or more sources of power that are generated on power machine 10. This can include either or both of pressurized fluid and electrical power.

The implement 100, which is sometimes known as an attachment or an attachable implement, has a power machine interface 110 and a tool 120, which is coupled to the power machine interface 110. The power machine interface 110 illustratively includes a machine mount 112 and a power port 114 for coupling with power machine 10. Machine mount 112 can be any structure capable of being coupled to the implement interface 40 of power machine 10. Power port 114, in some embodiments, includes hydraulic and/or electrical couplers. Power port 114 can also include a wireless electrical connection, as may be applicable on a given implement. While both machine mount 112 and power port 114 are shown, some implements may have only one or the other as part of their power machine interface 110. Other implements, such as a bucket and some simple forklifts, would not have a power port 114 at all (e.g., See FIG. 3). Some other forklifts may have an actuator for adjusting its tines vertically, horizontally, rotationally, or by extending them in response to power signals received from the power machine 10 at power port 114.

In instances where a power machine has a specific implement carrier, the machine mount 112 will include a structure that complements the specific implement carrier. For power machines without an implement carrier, the machine mount includes features to directly mount the implement 100 to the power machine 10 such as bushings to accept pins for mounting the implement to a lift arm and an actuator for moving the implement.

For the purposes of this discussion, implements can be categorized as simple or complex. A simple implement has no actuated work element. One example of a simple implement is a bucket or a forklift without actuable tines. A complex implement has at least one actuable work element such as a forklift with actuable tines. Complex implements are further divided into those that have one actuable work element and those that have multiple work elements. Some complex implements include features of a simple implement.

In FIG. 1, the implement 100 illustrates a tool 120 for a complex implement with a single work element 124. The tool 120 includes a frame 122, which is coupled with or integral to the machine mount 112. A work element 124 is coupled to the frame 122 and is moveable in some way (vertical, horizontal, rotation, extension, etc.) with respect to the frame. An actuator 126 is mounted to the frame 122 and the work element 124 and is actuable under power to move the work element with respect to the frame. Power is provided to the actuator 126 via the power machine. Power is selectively provided in the form of pressurized hydraulic fluid (or other power source) directly from the power machine 10 to the actuator 126 via power ports 60 and 114.

Figure 2:
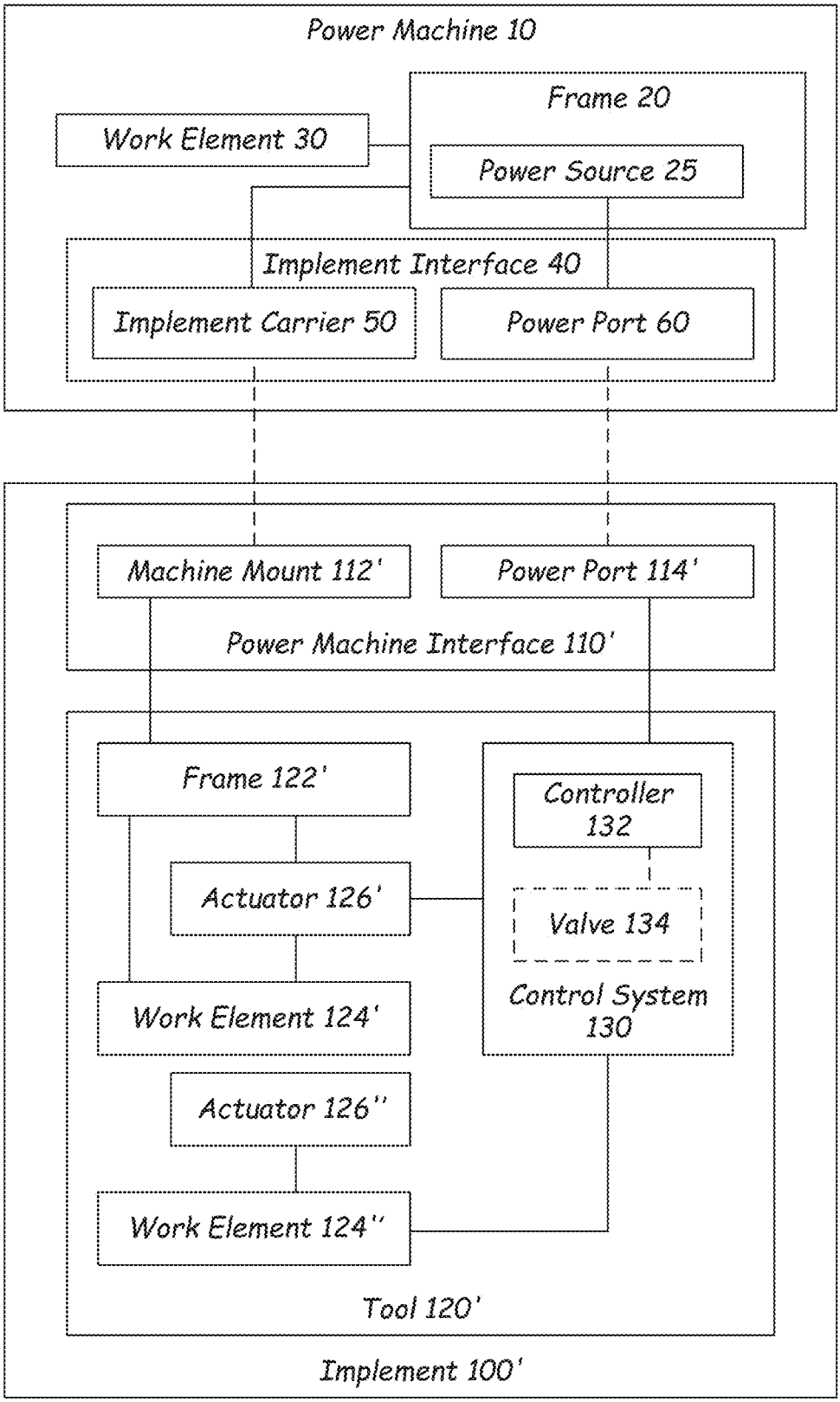

FIG. 2 illustrates an implement 100', which depicts a complex, multi-function implement. The features in FIG. 2 that are similarly numbered to those in FIG. 1 are substantially similar and are not discussed again here for the sake of brevity. Implement 100' has one or more additional work elements 124", which are shown in block form. Each work element 124" has a corresponding actuator 126" coupled thereto for controlling movement of the work element 124". A control system 130 receives power from the power machine and selectively provides power to the actuators 126' and 126" in response to signals from operator inputs. The control system 130 includes a controller 132, which is configured to receive electrical signals from the power machine 10 indicative of operator input manipulation and control power to the various actuators based on those electrical signals. The controller 132 can provide electrical signals to some or all of the actuators 126' and 126" to control their function. Alternatively, the controller 132 can control optional valve 134, which in turn controls actuation of some or all of the actuators 126' and 126" by providing pressurized hydraulic fluid to the actuators.

Although not shown in FIG. 2, in some instances, controller 132 can receive signals indicative of operator actuation of user inputs that are mounted on the implement, as opposed to the power machine. In these applications, the implement is controlled from an operator position that is located remotely from the power machine (i.e. next to the implement 100').

Figure 3:
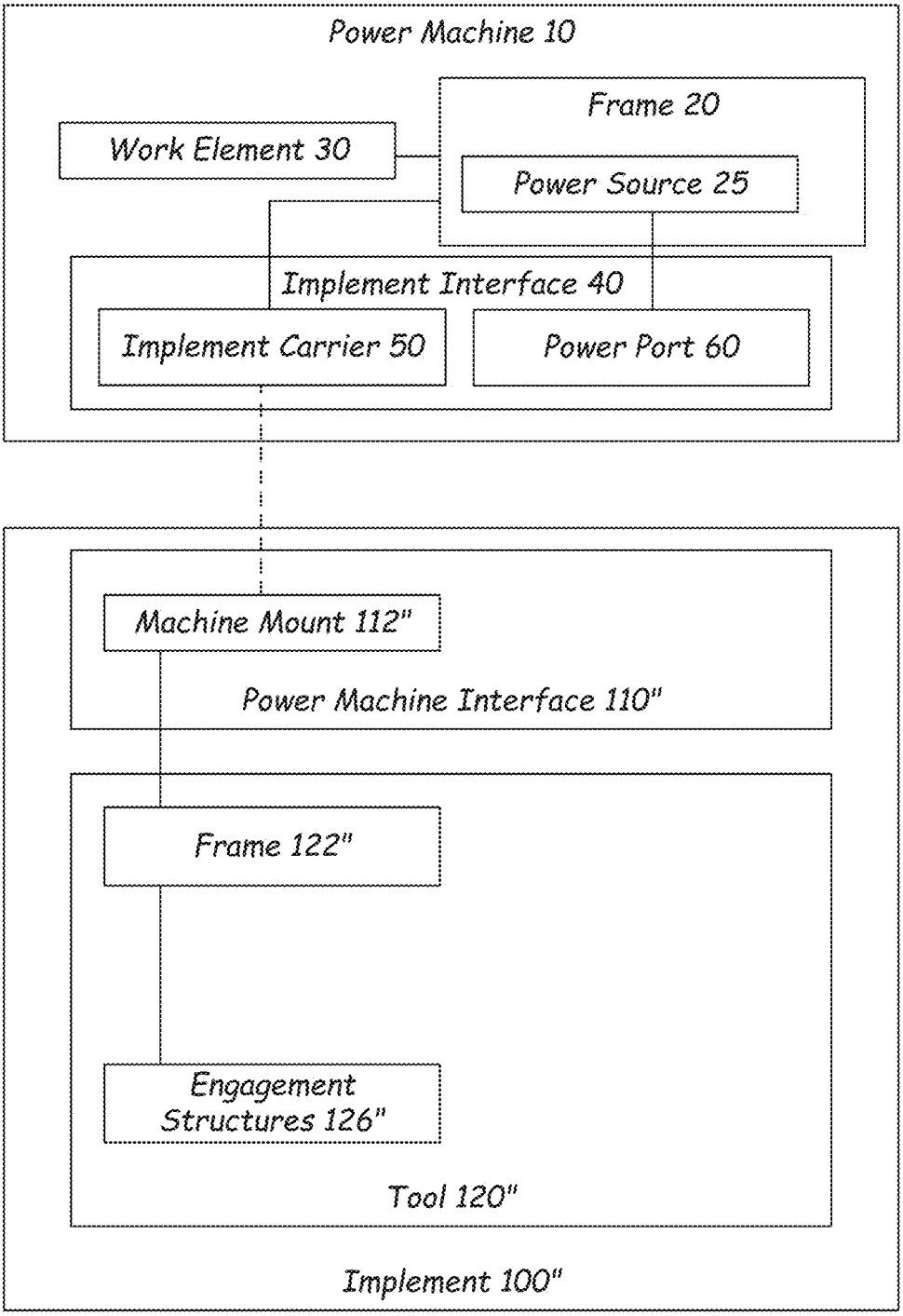

FIG. 3 illustrates an implement 100", which depicts a simple implement. The features in FIG. 3 that are similarly numbered to those in FIG. 1 are substantially similar and are not discussed again here for the sake of brevity. Implement 100" has one or more engagement structures 126" that is fixedly or moveably attached to the frame 122". Unlike a work element, which is powered by an actuator to move relative to the frame to perform a work function, the engagement structure can engage a medium to perform, in combination with the power machine, work. For example, a simple bucket has an engagement structure including a cutting edge and a defined volume that holds soil or material that is collected into a bucket. As another example, tines of a forklift can be mounted to the frame of the forklift implement for engaging a pallet. Such tines can be adjustable, but in many cases, the tines themselves are not moveable under power to perform work, but are instead engagement structures for engaging and supporting a load to be lifted and/or carried.

A power machine interface can include a machine mount in the form of a generally planar interface plate that is capable of being coupled to an implement carrier on a loader. In embodiments, various types of machine mounts can be employed. The power machine interface can also include a power port (e.g., see interfaces 110 and 110' of FIGS. 1 and 2 respectively), or not such as with the power machine interface 110" of FIG. 3. When the power machine interface includes a power port, the power port can include hydraulic conduits that are connectable to conduits on a power machine so that pressurized hydraulic fluid can be selectively provided to an actuator on the implement to actuate a connected working element. The power port can also include an electrical connection, which can be connectable to a controller (such as controller 132 of FIG. 2) and actuators on a valve (such as valve 134). The controller and valve can be included in a control system (such as control system 130) on the implement for controlling functions thereon.

Figure 4:
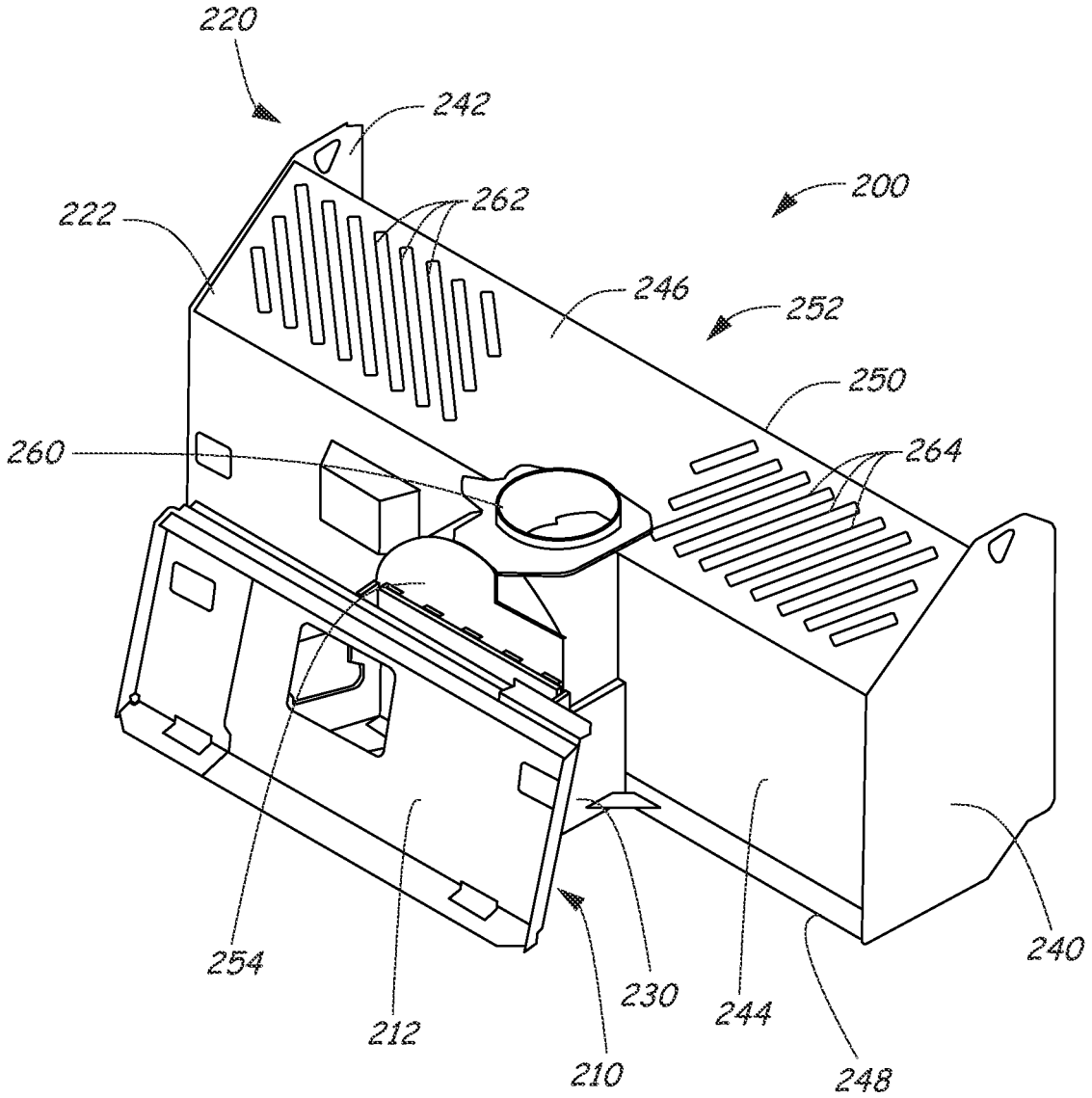
FIG. 4 is a diagrammatic perspective view of an implement including a snow blower having an auger housing that provides improved visibility for an operator of a power machine in accordance with exemplary embodiments.

Referring now to FIG. 4, shown is an implement 200, which can be in accordance with, and include features of, the implements illustrated in FIGS. 1-3. In the illustrated embodiment, implement 200 is a snow blower implement configured to be attached to a power machine 10, such as a loader. Implement 200 includes a power machine interface 210 having a machine mount 212, which can be any structure configured to be coupled to an implement interface (e.g., implement interface 40 discussed above) of a power machine. Power ports, such as port 114 discussed above, can be included on power machine interface 210 and can include hydraulic and/or electrical couplers. While implement 200 includes a power port in exemplary embodiments, the power port is omitted from FIG. 4 to simplify the illustration of other features.

The tool 220 of snow blower 200 is, in exemplary embodiments, a rotary snow blowing tool. Tool 220 includes a frame or auger housing 222 that is attached to machine mount 212 by rear frame supports 230. Auger housing 222 includes spaced apart side plates 240 and 242 on the outer sides of the implement 200. Housing 222 also includes a rear wall 244 and a top wall 246 extending angularly between the side plates 240 and 242. A bottom plate, represented generally at 248, also extends between the side plates 240 and 242 and functions to scrape or scoop snow into the housing. The top wall 246 has a ridge 250 at its upper and forward edge.

Implement 200 includes an auger or rotor, represented generally at 252 but not specifically illustrated in FIG. 4, at its forward end. The auger is mounted between the side plates 240 and 242. The auger is rotated through the use of a hydraulic or other motor (such as an actuator 126 or 126' shown in FIGS. 1-2) which is not illustrated in FIG. 4. A separate motor (such as an actuator 126 or 126' shown in FIGS. 1-2 but not shown in FIG. 4) drives an impeller or rotor 254. The impeller 254 is a conventional rotating fan type wheel unit that will receive snow from the auger 252, and will drive the snow upwardly through a discharge chute opening 260 and into a discharge chute. The discharge chute is omitted from FIG. 4 to better illustrate features of disclosed embodiments as discussed below.

To allow an operator of the power machine to have visibility of material, structures or obstacles approaching or entering the auger housing 222, implement 200 includes one or more apertures or groups of apertures 262 and 264 formed in a laterally extending section between endpoints such as side plates 240 and 242. The one or more apertures can be formed for example, in rear wall 244 or top wall 246 in a pattern or arrangement to provide visibility through the top wall, while minimizing the likelihood that snow, rocks or other material can pass through the apertures. While the apertures are formed in the top wall 246, in some embodiments, apertures can be formed into a back wall, or both a back wall and a top wall. Various auger housing shapes in some embodiments may require such configurations of apertures. In the illustrated example embodiment, the apertures 262 and 264 are two series or groups of diagonal slots, with each series formed on a different side of the top wall. In the illustrated embodiment, the diagonal slots in each group are formed parallel to one another, but this need not be the case in all embodiments. The aperture orientation, number, size, and spacing are selected to provide visibility through portions of the top wall, while minimizing the likelihood of material passing through the aperture. In some exemplary embodiments, the slots or other apertures are laser cut into top wall 246, but in other embodiments they can be formed using any suitable technique. While a series of slots are shown, the exact number of slots or apertures can vary in different embodiments. For example, in some embodiments, a single slot may be formed to define one (or both) of the groups 262 and 264. Alternatively, in some embodiments, a snow blower may have only one group of apertures. Further, while diagonally oriented parallel slots are shown as an example embodiment, in other embodiments, other shapes and patterns can be used. For example, the groups of apertures 262 and 264 can instead be one or more circular or other shaped apertures that allow for visibility while minimizing material passing through the apertures. The apertures in a group need not be uniform in size, shape, or orientation.

Figure 5:
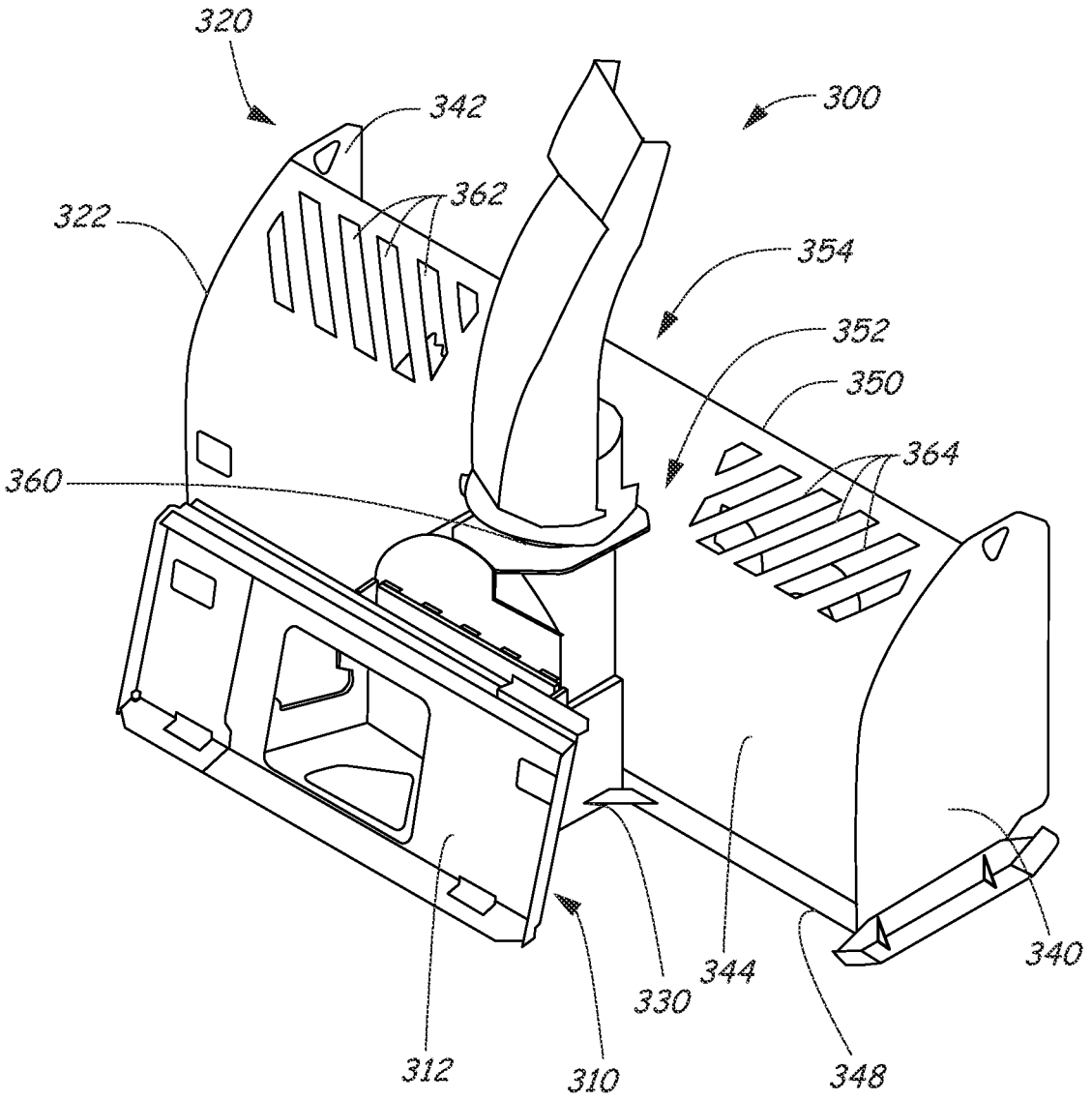
FIG. 5 is a diagrammatic perspective view of another implement including a snow blower having an auger housing that provides improved visibility for an operator of a power machine in accordance with an alternate embodiment.

Referring now to FIG. 5, shown is an implement 300, which can be in accordance with, and include features of, the implements illustrated in FIGS. 1-4. In the illustrated embodiment, implement 300 is a snow blower implement similar to snow blower implement 200 and similarly configured to be attached to a power machine 10, such as a loader. Implement 300 includes a power machine interface 310 having a machine mount 312, which can be any structure configured to be coupled to an implement interface (e.g., implement interface 40 discussed above) of a power machine. Power ports, such as port 114 discussed above, can be included on power machine interface 310 and can include hydraulic and/or electrical couplers. While implement 300 includes a power port in exemplary embodiments, the power port is omitted from FIG. 5 to simplify the illustration of other features.

The tool 320 of snow blower implement 300 is, in exemplary embodiments, a rotary snow blowing tool. Tool 320 includes a frame or auger housing 322 that is attached to machine mount 312 by rear frame supports 330. Auger housing 322 includes spaced apart side plates 340 and 342 on the outer sides of the implement 300. Housing 322 also includes a rear wall 344 extending between the side plates 340 and 342. Instead of including a top wall as was the case with implement 200 discussed above, rear wall 344 of implement 300 is curved forward near the top of the housing. A bottom plate, represented generally at 348, also extends between the side plates 340 and 342 and functions to scrape or scoop snow into the housing.

Implement 300 includes an actuator in the form of an auger or rotor, represented generally at 352. The auger is mounted between the side plates 340 and 342. The auger is rotated through the use of a hydraulic or other motor (such as an actuator 126 or 126' shown in FIGS. 1-2) which is not illustrated in FIG. 5. A separate motor (such as an actuator 126 or 126' shown in FIGS. 1-2 but not shown in FIG. 5) drives another actuator in the form of impeller or rotor 354. The impeller 354 is a conventional rotating fan type wheel unit that will receive snow from the auger 352, and will drive the snow upwardly through a discharge chute opening 360 and into a discharge chute.

To allow an operator of the power machine to have visibility of the implement workspace of the auger housing 322, implement 300 includes one or more apertures or groups of apertures 362 and 364 formed in a laterally extending section between endpoints such as side plates 340 and 342. The one or more apertures can be formed for example, in rear wall 344 in a pattern or arrangement to provide visibility through the rear wall, while minimizing the likelihood that snow, rocks or other material can pass through the apertures. In the illustrated example embodiment, the apertures 362 and 364 are two series or groups of diagonal slots, with each series formed on a different side of the top wall. In the illustrated embodiment, the diagonal slots in each group are formed parallel to one another, but this need not be the case in all embodiments. The aperture orientation, number, size, and spacing are selected to provide visibility through portions of the rear wall, while minimizing the likelihood of material passing through the apertures. In some exemplary embodiments, the slots or other apertures are laser cut into top wall 346, but in other embodiments they can be formed using any suitable technique.

Figure 6:
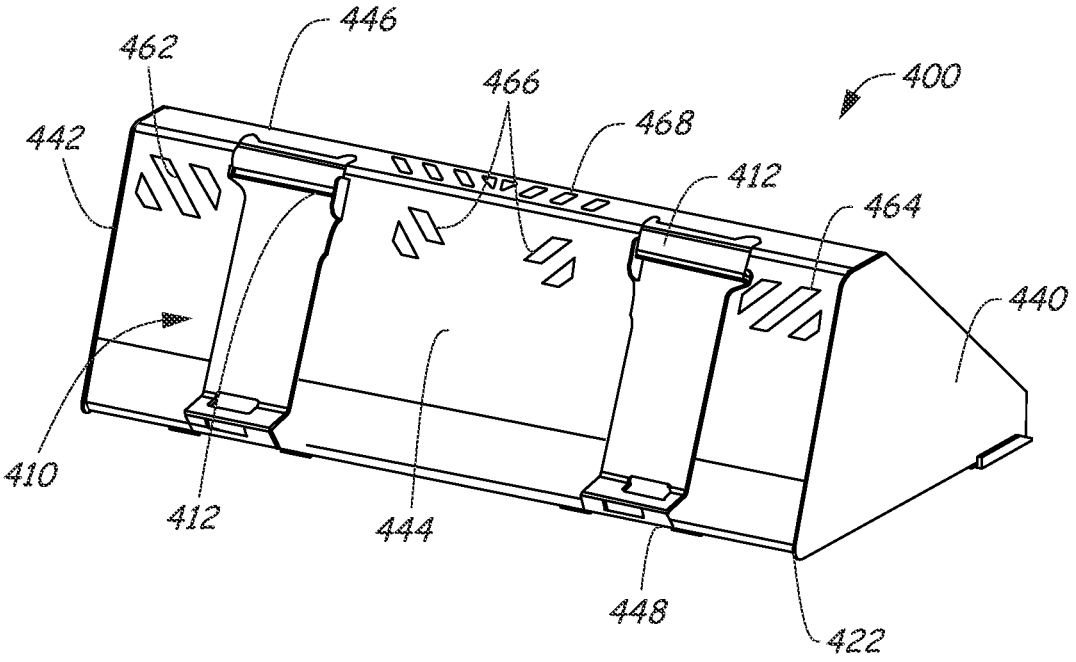
FIG. 6 is a diagrammatic perspective view of a bucket implement having a housing that provides improved visibility for an operator of a power machine in accordance with another exemplary embodiment.

Referring now to FIG. 6, shown is an implement 400 in the form of a bucket. This and other types of buckets, as well as other implements, can include apertures to provide visibility of the implement workspace in accordance with exemplary embodiments. As shown in FIG. 6, implement 400 has a frame 422 forming a housing, and includes side plates or walls 440 and 442, with a laterally extending section in the form of rear wall 444 extending between the side plates. A top wall 446 forms another laterally extending section between side plates 440 and 442. A bottom plate 448 also extends between the side plates 440 and 442. Groups of apertures 462, 464 and 466 are formed in the rear wall 444 or laterally extending section to provide visibility, to the operator positioned in the operator station, of the implement workspace forward of the rear wall 444. In this example embodiment, apertures 462 and 464 are positioned at left and right portions of rear wall 444, outside of machine mount 412 of power machine interface 410 and adjacent the corresponding side plates. Apertures 466 are positioned in middle or central regions of rear wall 444. In this embodiment, apertures 468 are also formed in top wall 446 to further provide visibility, through the top wall, of the implement workspace. While the various groups of apertures shown in FIG. 6 are diagonally extending slots, the shape and exact number of apertures can vary in different embodiments.

Figures 1, 7:
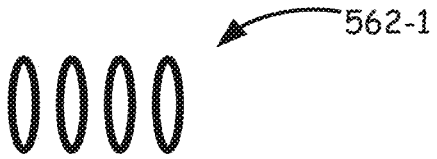
Figures 2, 7:
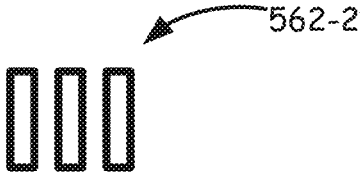
Figures 3, 7:
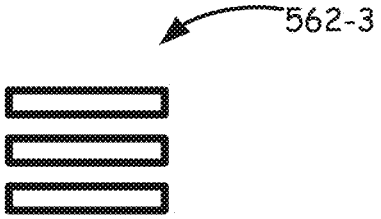

Further, while diagonally oriented slot shaped apertures are shown as an example embodiment, in other embodiments, other shapes and patterns can be used. For example, in various implements, one or more apertures 562-1 in the form of ovals can be used as shown in FIG. 7-1. In another embodiment as shown in FIG. 7-2, one or more vertically oriented rectangular apertures 562-2 can be used. In yet another embodiment, one or more horizontally oriented rectangular apertures 562-3 can be used as shown in FIG. 7-3. Still other shapes of apertures, such as circularly shaped apertures, can be used. The shape, number, orientation, grouping pattern and other features of the apertures can be selected as desired to achieve visibility of the implement workspace. The apertures in a group need not be uniform in size, shape, or orientation.

Although the present invention has been described with reference to preferred embodiments, workers skilled in the art will recognize that changes may be made in form and detail without departing from the spirit and scope of the invention.

What is claimed is:

1. A snow blower implement configured to be coupled to an implement interface of a power machine, the implement comprising:

a power machine interface having a machine mount configured to engage the implement interface of the power machine; and a tool coupled to the power machine interface, the tool having a frame forming an auger housing and the tool including an auger positioned within the auger housing, wherein the auger housing includes at least one group of apertures formed in the housing in a laterally extending pattern with the apertures of the at least one group of apertures positioned laterally relative to each other and configured and arranged to provide an operator of the power machine with visibility, through the at least one group of apertures, of the auger within the auger housing while operating the power machine.

2. The snow blower implement of claim 1, wherein the auger housing includes first and second spaced apart side plates on outer sides of the snow blower implement, and at least one laterally extending section between the first and second spaced apart side plates, wherein the at least one group of apertures is formed in the at least one laterally extending section of the auger housing.

3. The snow blower implement of claim 2, wherein the at least one laterally extending section includes a curved back wall and wherein the at least one group of apertures is formed in the curved back wall.

4. The snow blower implement of claim 3, wherein the at least one laterally extending section includes a bottom plate extending between the side plates and configured to function as a scraper to scoop snow into the auger housing.

5. The snow blower implement of claim 2, wherein the at least one laterally extending section includes a rear wall, a top wall extending between the side plates, and a bottom plate extending between the side plates and configured to function as a scraper to scoop snow into the auger housing.

6. The snow blower implement of claim 5, wherein the at least one group of apertures is formed in the top wall of the auger housing.

7. The snow blower implement of claim 1, wherein the at least one group of apertures formed in the auger housing includes at least one diagonally oriented slot formed in the housing.

8. The snow blower implement of claim 7, wherein the at least one group of apertures includes a plurality of diagonally oriented slots arranged parallel to each other.

9. The snow blower implement of claim 1, wherein the at least one group of apertures formed in the auger housing provide the operator of the power machine with visibility of an auger within the auger housing while operating the power machine.

10. The snow blower implement of claim 8, wherein the plurality of diagonally oriented slots arranged parallel to each other provide the operator of the power machine with visibility of an auger within the auger housing while operating the power machine.

11. A snow blower implement configured to be coupled to an implement interface of a power machine, the snow blower implement comprising:

a power machine interface having a machine mount configured to engage the implement interface of the power machine; and a rotary snow blowing tool coupled to the power machine interface, the rotary snow blowing tool having a frame forming an auger housing, wherein the auger housing comprises:

first and second spaced apart side plates on outer sides of the auger housing;

at least one laterally extending section between the first and second spaced apart side plates; and a plurality of diagonally oriented apertures arranged parallel to each other in the at least one laterally extending section to provide an operator of the power machine with visibility, through the plurality of diagonally oriented apertures, of an implement workspace in front of or within the auger housing.

12. The snow blower implement of claim 11, wherein the at least one laterally extending section, in which the plurality of diagonally oriented apertures are formed, is a top wall of the auger housing.

13. The snow blower implement of claim 11, wherein the at least one laterally extending section, in which the plurality of diagonally oriented apertures are formed, is a sloped back wall of the auger housing.

14. The snow blower implement of claim 11, wherein the plurality of diagonally oriented apertures includes a first group of apertures and a second group of apertures arranged in parallel patterns, each of the first and second groups of apertures formed on different sides of the at least one laterally extending section.

15. A snow blower implement configured to be coupled to an implement interface of a power machine, the snow blower implement comprising:

a power machine interface having a machine mount configured to engage the implement interface of the power machine; and a tool coupled to the power machine interface, the tool having a frame forming an auger housing, wherein the auger housing includes at least one group of apertures formed in the housing and configured and arranged in a laterally extending pattern to provide an operator of the power machine with visibility, through the at least one group of apertures, of operation of an auger within the auger housing while operating the power machine.

16. The implement of claim 15, wherein the auger housing includes first and second spaced apart side plates on outer sides of the implement, and at least one laterally extending section between the first and second spaced apart side plates, wherein the at least one group of apertures is formed in the at least one laterally extending section.

17. The implement of claim 16, wherein the at least one laterally extending section includes a curved back wall and wherein the at least one group of apertures is formed in the curved back wall.

18. A snow blower implement configured to be coupled to an implement interface of a power machine, the snow blower implement comprising:

a power machine interface having a machine mount configured to engage the implement interface of the power machine;

a tool coupled to the power machine interface, the tool comprising:

a frame forming an auger housing;

an actuator configured to perform a work function; and at least one diagonally oriented slot formed in the auger housing and configured and arranged to provide an operator of the power machine with visibility, through the at least one diagonally oriented slot of an implement workspace in front of and within the auger housing while operating the power machine.

19. A snow blower implement configured to be coupled to an implement interface of a power machine, the implement comprising:

a power machine interface having a machine mount configured to engage the implement interface of the power machine; and a tool coupled to the power machine interface, the tool having a frame forming an auger housing, wherein the auger housing includes at least one group of apertures formed in the housing and configured and arranged to provide an operator of the power machine with visibility, through the at least one group of apertures, of an implement workspace in front of or within the auger housing while operating the power machine, wherein the at least one group of apertures formed in the auger housing includes at least one diagonally oriented slot formed in the housing.

* * * * *